United States Patent [19]

Jaworski et al.

[11] 4,292,756

[45] Oct. 6, 1981

[54] TOY LAUNCHING DEVICE

[75] Inventors: Eugene Jaworski, Park Ridge; Jeffrey D. Breslow, Highland Park, both of Ill.

[73] Assignee: Marvin Glass & Associates, Chicago, Ill.

[21] Appl. No.: 198,839

[22] Filed: Oct. 20, 1980

[51] Int. Cl.[3] ..... A63H 1/00

[52] U.S. Cl. ..... 46/72; 46/47

[58] Field of Search ..... 46/47, 43, 67, 65, 71, 46/72, 269; 273/145 R, 108, 110

[56] References Cited

U.S. PATENT DOCUMENTS

| | | | |
|---|---|---|---|
| 1,514,355 | 11/1924 | Traubel | 273/145 R X |
| 1,781,333 | 11/1930 | Lehmann et al. | 46/47 X |
| 1,938,616 | 12/1933 | Alpen | 46/47 |
| 2,083,119 | 6/1937 | Hense | 273/110 X |
| 3,208,185 | 9/1965 | Silvera | 46/269 X |

*Primary Examiner*—Gene Mancene
*Assistant Examiner*—Mickey Yu
*Attorney, Agent, or Firm*—Mason, Kolehmainen, Rathburn & Wyss

[57] ABSTRACT

A launching device is provided for rapidly spinning and subsequently launching a top. The launcher is particularly suited for launching spherical or ovoid-shaped top elements such as real or artificial eggs. The launcher includes a centrally mounted, resilient friction wheel which is manually rotated through a crank and gear mechanism to impart rotation to the top elements. The launcher includes a dish-shaped platform for supporting the spinning elements and a pivotal platform portion which is manually depressed to release the spinning top elements onto an adjacent supporting surface.

6 Claims, 6 Drawing Figures

TOY LAUNCHING DEVICE

DESCRIPTION OF THE INVENTION

The present invention relates to toys and more particularly to an egg spinning toy for imparting rotary movement to one or more eggs, real or synthetic, with the result that the eggs are caused to rise up on their ends and eventually spin about their long axis, following which they may be easily discharged to an adjacent supporting surface where the spinning action continues.

It is an object of the present invention to provide a toy of the character described which may be easily and safely operated by children of all ages.

It is a further object of the invention to provide a toy of the indicated character which is of simple and rugged low-cost construction and in which the major portion of the moving parts are housed against small finger entanglement.

The invention both as to its organization and method of operation, together with further objects and advantages thereof, will best be understood by reference to the following specification taken in connection with the accompanying drawing, in which.

Figure 1:
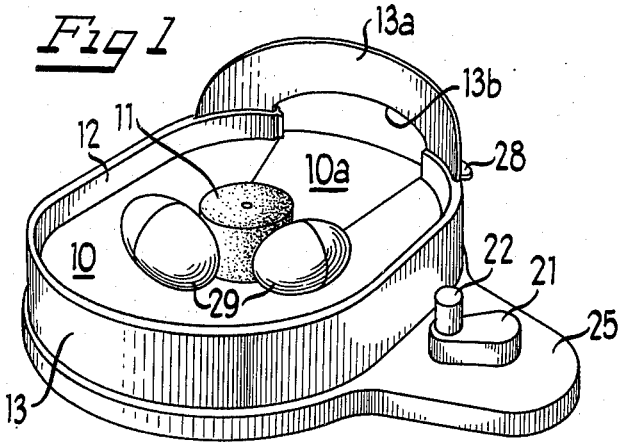
FIG. 1 is a perspective view of the present improved egg spinning toy.
Figure 4:
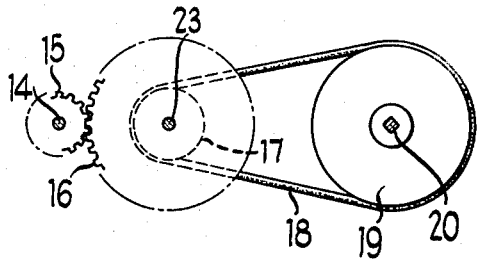
FIG. 4 is a sectional view taken along the lines 4—4 in FIG. 3.
Figure 2:
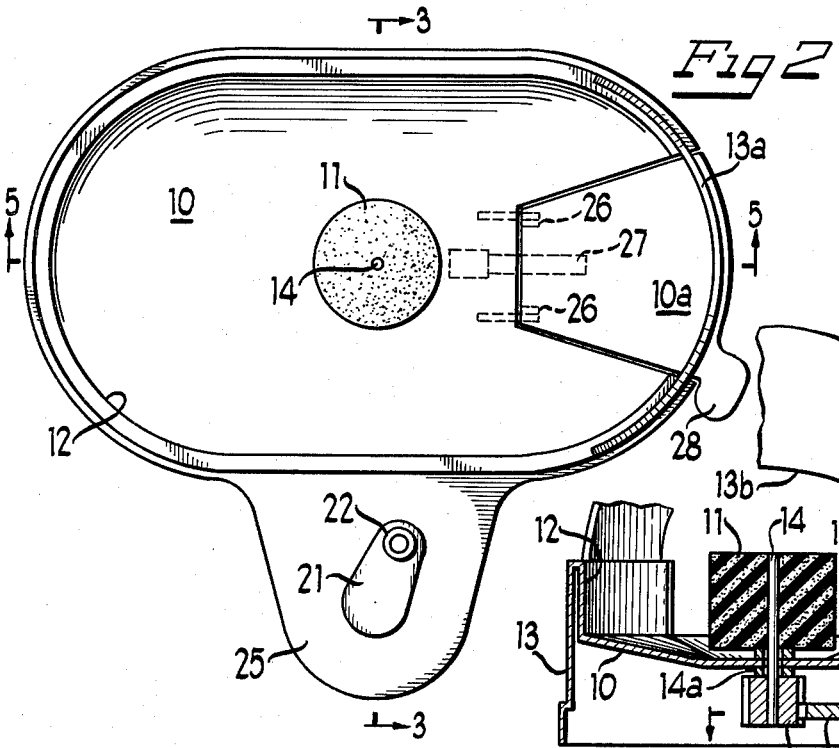
FIG. 2 is a top view of the device.

Referring now to the drawings and more particularly to FIGS. 1 and 2 thereof, the present improved egg spinning toy is there shown as comprising a shallow dish-shaped egg supporting platform 10, a rotatable friction wheel 11 and a fence 12 surrounding the outer edge of the platform to prevent eggs from being thrown off of the platform during rotation of the friction wheel 11. The platform 10 is adapted to be supported in an elevated position above a supporting surface, such as a table top, by means of a supporting skirt 13 which completely surrounds the oval-shaped platform. For the purpose of easily transporting the toy from place to place, the skirt 13 is provided with an upstanding handle portion **13*a* which is separated from the fence 12 by a band receiving opening 13*b***.

Figure 3:
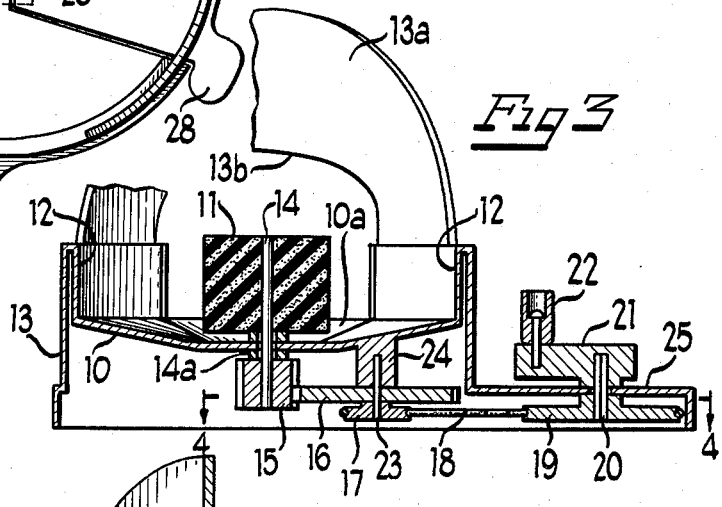
FIG. 3 is a sectional view taken along the lines 3—3 in FIG. 2.

As best shown in FIGS. 2 and 3 of the drawing, the friction wheel 11, which may be made of cork, sponge rubber or urethane foam is disposed at the approximate center of the platform 10 above the top egg supporting surface of the platform. This wheel is fixedly mounted upon one end of a drive shaft 14 which is journaled for rotation in a bearing **14*a* extending through a centrally disposed opening in the platform 10**.

For the purpose of rotating the shaft 14 and the friction wheel 11 carried thereby, a drive mechanism is provided which includes a pinion gear 15 fixedly mounted on the lower end of the shaft 14, a meshing enlarged drive gear 16, a small diameter belt or sprocket pulley 17, a drive belt or chain 18, a large diameter belt or sprocket wheel 19, a shaft 20, and manually operable handle 21 which carries a finger actuable pin 22 at the outer free end thereof. More specifically, the drive gear 16 and pulley 17 are fixedly interconnected for rotation about a supporting shaft 23 which is fixedly mounted within a post 24 projecting downwardly from the platform 10. The movable parts 18 and 19 are housed within an extended part 25 of the supporting skirt 13. Thus all movable parts of the toy with the exception of the handle 21 and pin 22, are housed within the skirt 13 and its extension 25 below the upper surface of the platform 10, thereby to minimize the possibility of small finger entanglement with the moving components of the above-described drive mechanism when the toy is in use. Preferably, the components 10, 12, 13, **13*a* and 25** are of one-piece molded plastic construction.

Figure 5:
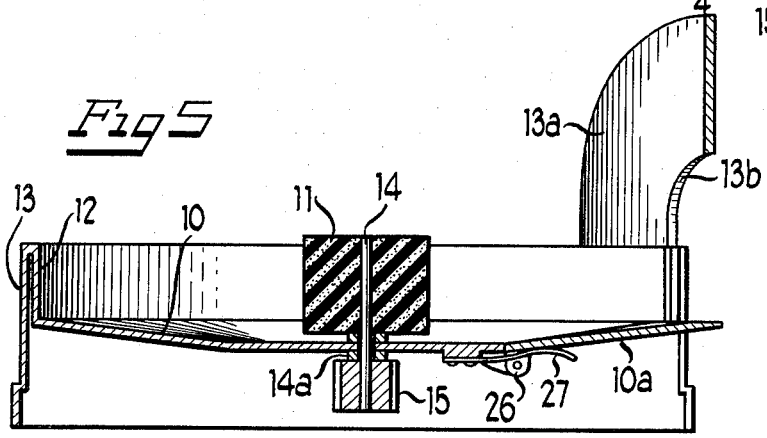
FIG. 5 is a sectional view taken along the lines 5—5 in FIG. 2.
Figure 6:
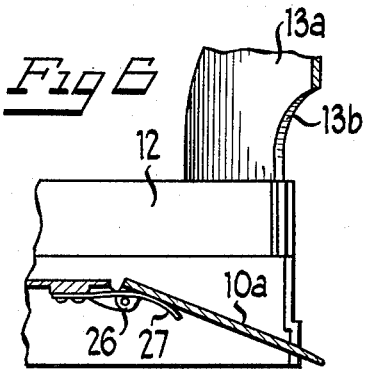
FIG. 6 is a fragmented sectional view similar to FIG. 5, but showing certain parts of the device in changed relative positions.

In order to cause eggs spinning on the platform 10 to exit from the toy onto an adjacent supporting surface where the eggs may continue their spinning activity, the platform 10 is provided with a manually movable wedge-shaped segment **10*a*, the outer edge of which substantially spans and defines the lower edge of the hand receiving opening 13*b*. Beneath this opening, the fence 12 and skirt 13 are cut away to accommodate the projecting outer end of the segment 10*a* for up and down movement within the open space thus provided in the fence and skirt. Preferably, the end edges of the fence 12 which define this open space overhang the side edges of the segment 10*a* to act as stops limiting upward movement of the segment 10*a*. At its opposite rear edge, the segment 10*a* is supported for up and down pivotal movement relative to the other portions of the platform 10 by means of conventional pivot pin assemblies 26 located at the respective ends of this edge of the segment 10*a* and mounted upon the underside of the stationary portions of the platform 10. As best shown in FIGS. 5 and 6 of the drawing, spring means in the form of a leaf spring 27, screw anchored to the underside of the stationary portion of the platform 10, are provided for normally biasing the segment 10*a* upward so that the top surface thereof is coplanar with the top surface of the remaining portions of the platform 10. Along its extended outer edge the segment 10*a* is provided with an integrally formed finger tab 28 for manually pivoting the segment downward against the bias of the leaf spring 27**.

In use, the above-described toy is supported upon a horizontally disposed supporting surface such as a floor or table top, and one or more eggs 29 are deposited upon the top surface of the platform 10 in the manner illustrated in FIG. 1 of the drawing. These eggs may be artificial or hard boiled real eggs. Due to the downward sloping surface of the platform 10, the eggs roll down these surfaces and the outer surfaces thereof contact the surface of the friction wheel 11. With the eggs 29 and friction wheel 11 in contact with each other, rotation of the wheel 11 results in spinning of the eggs, first about their respective short axis and later, as the spinning speed increases, about their respective long axis. In other words, the spinning movement causes the eggs to stand on end and continue spinning about their respective long axis due to repeated contact with the friction wheel 11, in much the same fashion as a spinning top sustains its upright position when spinning at relatively high speed.

High speed rotation is imparted to the friction wheel 11 through manual rotation of the handle 21 to activate the above-described drive mechanism comprising the drive components 20, 19, 18, 17, 16, 15 and 14. Thus, as the handle 21 is rotated, the drive wheel or sprocket 19 is likewise rotated to produce rotation of the friction wheel 11 through the belt or chain 18, the pulley or sprocket wheel 17 and the meshing gears 16 and 15. Due to the speed multiplying action of the described drive train, a relatively high rotational speed of the friction wheel 11 is achieved in response to relatively slow rotation of the handle 21.

After the eggs 29 have been caused to spin in upright positions about their long axis in the manner explained above, they may be released from the toy to continue spinning on the adjacent supporting surface by actuating the finger tab 28 to depress the platform segment 10*a* to the lowered position shown in FIG. 6 of the drawings against the bias of the leaf spring 27. This permits the spinning eggs to slide down the upper surface of the segment 10*a* and through the openings in the fence 12 and skirt 13 onto the horizontal surface adjacent the toy where the eggs will continue to spin until the kinetic energy stored therein is substantially exhausted. Obviously, when the tab 28 is released, the platform segment 10*a* rebounds to its normal position under the influence of the spring 27.

While the best mode of practicing the invention has been described, it will be understood that various modifications may be made therein which are within the true spirit and scope of the invention as defined in the appended claims.

I claim:

1. An egg spinning toy comprising a dish-shaped platform adapted to support one or more eggs to be spun, said platform being provided with a manually movable segment which is adapted to be manually operated to permit an egg spinning on said platform to move off of said platform onto an adjacent supporting surface, a friction wheel disposed at least in part above the bottom surface of said dish and adapted to contact the outer surface of an egg disposed in said platform, and means for producing relative rotation between said platform and said wheel, thereby to affect spinning of an egg disposed on said platform by its long axis.

2. An egg spinning toy as claimed in claim 1, wherein a fence is provided which substantially encloses said platform to prevent eggs disposed on said platform from being thrown off of said platform as a result of relative rotation between said platform and said wheel.

3. An egg spinning toy as claimed in claim 1, wherein spring means are provided for normally biasing said movable segment into the same planar position as the remainder of said platform.

4. An egg spinning toy comprising a stationary dish-shaped platform adapted to support one or more eggs to be spun, said platform being provided with a manually movable segment which is adapted to be manually operated to a lowered position to permit an egg spinning on said platform to move off of said platform onto an adjacent supporting surface, said platform being provided with one opening at the approximate center thereof, a rotatable friction wheel disposed above said opening and adapted to contact the outer surface of an egg disposed on said platform, and manually operable drive means for imparting rotary movement to said friction wheel.

5. An egg spinning toy as claimed in claim 4, wherein a fence is provided which substantially encloses said platform at the outer edges thereof and functions to prevent eggs disposed on said platform from being thrown off of said platform as a result of relative rotation between said platform and said wheel.

6. An egg spinning toy as claimed in claim 4 or claim 5, wherein said drive means is at least in part disposed below the underside of said platform.

* * * * *